United States Patent [19]

Penniman et al.

[11] Patent Number: 4,684,440

[45] Date of Patent: Aug. 4, 1987

[54] METHOD FOR MANUFACTURING PAPER PRODUCTS

[75] Inventors: John G. Penniman, Carmel; Maria S. Reichlin, White Plains, both of N.Y.

[73] Assignee: Paper Chemistry Laboratory, Inc., Carmel, N.Y.

[21] Appl. No.: 806,884

[22] Filed: Dec. 9, 1985

[51] Int. Cl.[4] ..... D21D 3/00; D21F 11/00

[52] U.S. Cl. ..... 162/184; 162/204

[58] Field of Search ..... 162/135, 184, 185, 199, 162/102, 173, 170, 171, 204, 207; 34/9, 111

[56] References Cited

U.S. PATENT DOCUMENTS

| | | | |
|---|---|---|---|
| 1,846,474 | 2/1932 | Darling | 34/9 X |
| 1,966,458 | 7/1934 | Novak | 162/184 X |
| 2,132,016 | 10/1938 | Du Bois | 162/135 X |
| 3,293,115 | 12/1966 | Lucken | 162/184 |
| 3,491,457 | 2/1970 | Scheiber et al. | 34/1 |
| 3,494,826 | 2/1970 | Scheiber | 162/168 |
| 3,640,763 | 3/1972 | Lard | 117/126 GF |
| 3,800,433 | 4/1974 | Kubodera | 34/135 |
| 3,912,835 | 10/1975 | Uchida | 427/316 |
| 3,939,091 | 2/1976 | Kelly, Jr. | 252/189 |
| 4,113,506 | 9/1978 | Sackmann et al. | 106/238 |
| 4,304,626 | 12/1981 | Shaw et al. | 162/168 R |
| 4,323,490 | 4/1982 | Topfl | 523/409 |
| 4,332,748 | 6/1982 | Fremont | 264/11 |
| 4,338,352 | 6/1983 | Allan et al. | 427/391 |
| 4,376,078 | 3/1983 | Topfl | 260/404.5 |
| 4,379,882 | 5/1983 | Miyata | 524/436 |
| 4,383,860 | 8/1983 | Uhlemayr et al. | 106/27 |
| 4,465,856 | 8/1984 | Horiuchi et al. | 564/206 |
| 4,517,351 | 5/1985 | Szymanski et al. | 527/312 |
| 4,517,751 | 5/1985 | Ross et al. | 34/10 |
| 4,542,233 | 9/1985 | Raue et al. | 548/455 |

FOREIGN PATENT DOCUMENTS

| | | |
|---|---|---|
| 1138247 | 12/1982 | Canada . |
| 1507595 | 4/1978 | United Kingdom . |
| 1574969 | 9/1980 | United Kingdom . |

OTHER PUBLICATIONS

Abstract of Russian Pat. No. 372,305 (11/73).
Abstract of Russian Pat. No. 674,249 (7/79).
Abstract of Russian Pat. No. 1,018,709 (5/83).
Abstract of Russian Pat. No. 1,035,113 (8/83).
Abstract of Russian Pat. No. 1,124,067 (11/84).
Abstract of French Pat. No. 2,501,006 (9/82).
Abstract of East German Pat. No. 136,845 (8/79).
Abstract of West German Pat. No. 1,619,308 (9/70).
Abstract of West German Pat. No. 1,769,404 (7/71).
Abstract of West German Pat. No. 3,021,838 (12/81).
Abstract of West German Pat. No. 3,049,432 (7/82).
Abstract of West German Pat. No. 3,235,527 (9/82).
Abstract of West German Pat. No. 3,301,025 (7/84).
Abstract of West German Pat. No. 3,316,880 (11/84).
Abstract of Belgian Pat. No. 826,360 (9/75).
Abstract of Japanese Pat. No. 70/027526 (8/70).
Abstract of Japanese Pat. No. 71/004333 (2/71).
Abstract of Japanese Pat. No. 71/034921 (10/71).
Abstract of Japanese Pat. No. 73/009203 (4/73).
Abstract of Japanese Pat. No. 48/056903 (11/73).
Abstract of Japanese Pat. No. 48/099405 (12/73).
Abstract of Japanese Pat. No. 74/033682 (6/75).
Abstract of Japanese Pat. No. 75/016797 (6/75).
Abstract of Japanese Pat. No. 75/020606 (7/75).
Abstract of Japanese Pat. No. 50/138110 (11/75).
Abstract of Japanese Pat. No. 51/018762 (2/76).
Abstract of Japanese Pat. No. 51/040408 (4/76).
Abstract of Japanese Pat. No. 51/082010 (7/76).

(List continued on next page.)

*Primary Examiner*—Peter Chin
*Assistant Examiner*—Thi Dang
*Attorney, Agent, or Firm*—Pennie & Edmonds

[57] ABSTRACT

Novel pulp, paper and paperboard manufacturing methods utilizng non polar organic solvents. These solvents can be introduced into the pressing operation of the pulp, paper, or paperboard making machine or can be substituted for water at any point after the formation stage. The result is a significant saving in dryer energy which can be translated to greater productivity in dryer-limited processes, accompanied by an improvement in tensile strength and other physical properties.

23 Claims, 3 Drawing Figures

OTHER PUBLICATIONS

Abstract of Japanese Pat. No. 51/109325 (9/76).
Abstract of Japanese Pat. No. 52/066707 (6/77).
Abstract of Japanese Pat. No. 54/055622 (5/79).
Abstract of Japanese Pat. No. 54/145299 (11/79).
Abstract of Japanese Pat. No. 55/013732 (1/80).
Abstract of Japanese Pat. No. 55/075404 (6/80).
Abstract of Japanese Pat. No. 55/093899 (7/80).
Abstract of Japanese Pat. No. 55/093900 (7/80).
Abstract of Japanese Pat. No. 56/026095 (3/81).
Abstract of Japanese Pat. No. 56/063007 (5/81).
Abstract of Japanese Pat. No. 58/023968 (2/83).
Abstract of Japanese Pat. No. 58/036295 (3/83).
Abstract of Japanese Pat. No. 58/105692 (6/83).
Abstract of Japanese Pat. No. 53/056225 (7/78).
H. F. Rance, (ed.) Handbook of Paper Science, Elsevier Scientific Publishing Co., The Netherlands (1980).
J. P. Casey, (ed.) Pulp and Paper Chemistry and Chemical Technology, 3rd ed., John Wiley & Sons, New York (1980).

Encyclopedia of Chemical Technology, vol. 16, pp 768–801 (1984).

FIG. 1 Fourdrinier Papermaking Machine (Prior Art)

METHOD FOR MANUFACTURING PAPER PRODUCTS

TECHNICAL FIELD

The invention relates to novel methods for manufacturing pulp, paper and paper board products. Specifically, novel methods are disclosed for removing water from the paper product during post-formation, including consolidation, pressing and drying operations, as well as for modifying and improving the properties of the final product.

BACKGROUND ART

All systems for manufacturing pulp, paper and paperboard include a series of operations and processes. Typically, wood is either digested chemically or ground up mechanically to form pulp. The chemical pulp must be washed, and both grades are often bleached. Pulping, bleaching and washing are generally carried out in the pulp mill; subsequent operations take place in the paper mill.

In the preparation of paper from pulp stock, water contributes in several ways. In addition to providing a medium through which shear forces may be transmitted to the fibers during beating, water acts as a vehicle of suspension in which the fibers, having been well dispersed, can be brought together to give a sheet having the desired formation.

Refining is one of the last steps to take place prior to dilution with process white water to form headbox furnish. The papermaker has the ability to control this important operation in order to optimize subsequent process and physical property parameters.

Refining consists of pumping the pulp slurry through a series of metal discs moving at a high speed controllable by the papermaker. During refining, the cellulose fibers are swollen, cut and macerated in order to develop fibrillation. This fibrillation increases the number of interfiber contacts during formation of the paper and bonding during subsequent pressing and drying operations. For example, a sheet that is formed from an unbeaten pulp has a low density and is rather soft and weak. If the same pulp is well-beaten, however, the resultant paper is much more dense, hard, and strong.

After refining, the pulp slurry is reduced in consistency by the addition of white water, prior to being pumped to the headbox. The concentration of solids in the headbox furnish is referred to as "consistency" and it typically ranges between 0.2 and 1%. In general, the lower the consistency the better the formation or homogeneity of appearance. From the headbox, the furnish is pumped onto a wire which, on a modern machine, can be moving at a speed of about 700 to 2000 m/min.

Continuous sheet forming and drying can be accomplished using three different types of equipment: the cylinder, Fourdrinier (i.e., single wire), and twin-wire machines. In the former, a wire-covered cylinder is mounted in a vat containing the refined fiber slurry. As the cylinder revolves, water drains inward through the screen, thus forming the paper web on the outside of the cylinder. The wet web is removed at the top of the cylinder, passes through press rolls for water removal, and is then passed over steam-heated, cylindrical drying drums. The Fourdrinier machine is more complex and basically consists of a long continuous synthetic fiber or wire screen (the "wire") which is supported by various means to facilitate drainage of water. The fiber slurry, which is introduced at one end of the machine through a headbox and slice, loses water as it progresses down the wire, thereby forming the web upon the screen. The web is then directed to the press and dryer sections as in the cylinder machine.

The twin-wire machine is the latest development and consists essentially of two opposing wires. Twin-wire formers have replaced the Fourdrinier wet-ends on many machines, particularly for lightweight sheets, e.g., tissue, towel, and newsprint. Twin-wire formers also are operated successfully on fine paper, corrugated media, and liner board grades. In twin-wire formers, the water is drained from the slurry by pressure rather than by a vacuum. The two wires, with the slurry between, are wrapped around cylinder or set of supporting bars or foils. The tension in the outer wires results in a pressure which is transmitted through the slurry to the supporting structure; the pressurized slurry drains through one or both of the wires.

Subsequent to stock preparation and dilution, the paper furnish is usually fed to the paper machine through one or more screens or other filtering devices to remove impurities. It then enters a flow spreader which provides a uniform flowing stream along the width of the paper machine. The flow spreader discharges the slurry into a headbox, where fiber agglomeration is prevented by agitation. Pressure is provided to cause the slurry to flow at the necessary velocity through the slice and onto the moving wire.

The wire is mounted over the breast roll at the intake end and at the couch roll at the discharge end. Between the two rolls, it is supported for the most part by table rolls, foils and suction boxes. A substantial vacuum is developed in the downstream nip between the table roll and the wire, and promotes water drainage from the slurry on the wire. As speeds increase, however, the suction can become too violent and deflect the wire, causing stock to be thrown into the air. A more controlled drainage action is accomplished by the use of foils. These are wing-shaped elements which support the wire and induce a vacuum at the downstream nip. Foil geometry can be varied to provide optimum conditions. After passing over the foils or table rolls, the wire and sheet pass over suction boxes, where more water is removed. Most machines also include a suction couch roll for further water removal.

In its most typical form, the formation of the paper web takes place in the first few feet on the screen of the papermaking machine. The stock issuing from the slice is a suspension of fibers in water, typically containing from 0.2 to 1.0% dry solids in a layer some 6–18 mm deep and up to several meters wide. It is deposited on, and drains through, an endless band of a woven synthetic fiber or metal fabric, called wire. At very low speeds, the force of gravity predominates in causing the drainage. At higher speeds, the action of gravity becomes negligible compared with the pumping action of the drainage elements (i.e., the table rolls or foils). A visible change occurs in the appearance of the stock as it proceeds down the wire when its concentration reaches about 2%. At this level, the surface ceases to appear mobile, loses its liquid sheen, and takes on a matte appearance. At this point in the process, the drainage elements are no longer effective for removing water because the web is formed. Next, consolidation begins, assisted by the action of the suction boxes. Some slight rearrangement of the fibers may still be achieved by the pressure of a light, permeable roller. Then the web will be taken from the roll for subsequent pressing, drying and finishing.

The sheet leaving the wet end has a consistency of 18–23%. Thus, it is possible to remove additional water mechanically without adversely affecting sheet properties. This is achieved in rotary presses, of which there may be one or several on a given paper machine. The press rolls may be solid or perforated and, often, suction is also applied through the interior of the rolls. The sheet is passed through the presses on continuous felts (one for each press), which act as conveyors and porous receptors of water. The water content of the sheet usually can be reduced by pressing to a consistency of about 30 to 40% without crushing.

Crushing, the direct flow of water in the sheet, occurs when too much pressure is applied to the wet sheet by the presses. Crushing can be avoided by applying pressure gradually, since less water is initially removed this way and the fibers are not so likely to be pushed apart. Also, crushing can be avoided by modifying the press rolls and felt construction to allow for increased water-removal rates. The sheet can stand higher and higher pressure as water is removed and the sheet becomes stronger. Graduated pressure is particularly important on heavy boards inasmuch as the danger of crushing increases for greater thicknesses of paper product. Pressing multicylinder boards while they are too wet may also lead to ply separation as well as crushing.

At a consistency of about 30 to 40%, additional water removal by mechanical means is not feasible and evaporative drying must be employed. This is a costly process and often is the production bottleneck of papermaking. The dryer section usually includes a series of steam-heated cylinders. Alternate sides of the wet paper are exposed to the hot surface as the sheet passes from cylinder to cylinder. In most cases, except for heavy board, the sheet is held closely against the surface of the dryers by a fabric having carefully controlled permeability to steam and air. Heat is transferred from the hot cylinder to the wet sheet, and water evaporates. The water vapor is removed by way of elaborate air systems. Most dryer sections are covered with hoods for collection and handling of the air, and heat recovery is practiced in cold climates. The final consistency of the dry sheet is usually between about 92–96 weight percent, depending upon the type of paper product being manufactured.

The efficiency of the drying sequence is dependent upon such factors as the amount of applied pressure which squeezes the wet web between the felts, the efficiency with which water condensed within the dryer cylinder is physically removed, the nature and conditions of the carrier felt, if any, and the ventilation of the pockets between dryers. During the drying sequence, the consistency of the product is increased from the entry level of generally about 30–40% up to that of the emerging dry paper product, i.e., 92–96%.

The energy requirements for removal of water depend upon the form of water which is present in the paper product. A major portion of free water, that which exists over and above what is required to saturate the fibers, can be removed on the wire by gravity or suction. Capillary water and an additional portion of the free water are removed by a pressing operation. The most tenaciously held water (i.e., that within the lumen and pores of the fiber wall) requires a significantly greater expenditure of energy for its removal, and this is generally accomplished utilizing thermal drying.

During the early stages of drying, the fibers are free to slide over one another, but as the free water is driven off, the fibers are drawn closer together and bonding begins to take place. Surface tension is primarily responsible for drawing together the fibers in this stage, but later, molecular attraction brings about the final bonding between fibers. No appreciable fiber-to-fiber bonding takes place until the consistency is raised above about 40 percent, but once the critical drying point is reached, shrinkage begins to take place and bonding begins.

In summary, the three steps which are necessary to form a final paper product from wood pulp all relate to the removal of water from the fiber or web. These include:

(1) depositing pulp upon a screen (or "wire") to form a web of paper fiber. This step, known in its initial stage as formation, is usually accomplished by passing an aqueous dispersion of a low concentration of pulp (e.g., 0.2% to 1%) over the screen. This screen, assisted in certain situation by vacuum or suction, increases the consistency of the web to approximately 18 to 23 percent.

(2) compressing or squeezing the web in a "press section" to further remove water. This is usually accomplished by felt presses, a series of rollers each having a felted band for contact with the web. These presses remove additional free water and some capillary water, thus resulting in an increase in consistency of the web to a range of about 30 to 40 weight percent.

(3) drying the web utilizing steam-heated equipment in a "dryer section." Here, the remaining water content of the web is reduced to that desired for the final specific product, the consistency of which typically ranges between about 92 to 96 weight percent.

As mentioned above, the greatest energy use occurs during the drying of the paper product. For example, in the manufacture of thicker grades of paper product, such as board, in one case 88.6% of paper mill steam usage was reported to be at the drying cylinders.

Drying is a relatively expensive process, and the cost of drying is always a major part of the processing cost of the final paper, thus any significant savings in energy in the drying stage would directly result in significant cost savings.

SUMMARY OF THE INVENTION

The invention relates to a method for increasing the rate of water removal from a web of paper product during consolidation, pressing and drying which comprises treating the web with at least one water-insoluble solvent to preferentially wet the fibers, thereby at least partially displacing water from the web. This solvent can be applied "straight" (i.e., alone or in substantially pure form) or in the form of a solvent and water emulsion. When solvent and water emulsions are utilized, such emulsions are preferably applied to the web during pressing or immediately after pressing. The treating step may also include adding a sufficient amount of solvent to completely wet the fibers in the web to displace some of the water therefrom. The fibers can be wet by the solvent prior to, during,or after pressing.

The web can be treated by a portion of the solvent prior to pressing and by a portion of the solvent during pressing. Alternatively, the solvent may be introduced continuouslv during pressing, and can be applied directly to the web or to the press section felt, thus being indirectly transferred to the web.

Preferred solvents are paraffinic, aliphatic, or aromatic organic compounds as well as halogenated hydrocarbons. These methods also contemplate adding at least one chemical additive to the solvent for modifying or improving a property of the final product prior to treating the web with the solvent. Preferably, this solvent/additive mixture is applied to the web after pressing for maximum retention and thus, optimum improvement of the property.

The invention also relates to various improvements in a paper product manufacturing process which includes the steps of depositing pulp upon a screen to form a web of paper fiber, removing a portion of the water from the deposited web by pressing the web in press means having a felt press surface, and drying the pressed web. One improvement comprises treating the felt press surface with a sufficient amount of at least one water-insoluble solvent to displace water in the felt surfaces. The solvent then preferentially wets the fibers of the web, providing an increased consistency exiting the press section and also thereby making the water more readily available for removal from the web during pressing. The solvent may be intermittently or continuously introduced onto the felt surface. As noted above, an additive for modifying or improving a property of the final paper product may be added to the solvent before or after treatment in the press section.

In an alternate embodiment, the improvement comprises increasing the drying rate of the pressed web by at least partially displacing water in the web with at least one water-insoluble solvent during the pressing and/or drying steps. In these methods, the web may be treated by a first portion of the solvent during pressing and by a second portion of the solvent after pressing. Also, a chemical additive for improving a property of the final paper product may be added to the either or both solvent portions prior to treating the web, if desired.

An alternate embodiment relates to increasing the rate of production of dry paper product by displacing water in the web with at least one water-insoluble solvent during the pressing step and increasing the quantity of press web to be dried in the drying step. These improvements reduce the energy consumption for drying the web or increase the production rate for the same quantity of energy consumption. The prospect of substantially increasing production at the same level of energy consumption or substantially decreasing energy consumption offers a large economic incentive for adopting the methods of this invention.

The invention also relates to a method for improving at least one property of a paper product after formation of a fiber web which comprises treating the web with a sufficient amount of at least one water-insoluble solvent prior to pressing the web to displace at least a portion of water from the web and obtain greater compaction during pressing so as to improve at least one property of the final paper product. The solvent can be applied to the web straight or in the form of an emulsion. It is also possible to add to the solvent at least one paper product property improving additive.

Alternately, the web can be treated by the solvent/additive or solvent emulsion/additive after pressing to obtain improvement of a property of the final paper product. This alternative embodiment provides the most efficient application of the additive. Such a property improving additive can be one for imparting greater wet or dry strength, better sizing, and changes in color or brightness, with the use of the solvent or solvent/emulsion before pressing. Without an additive, the solvent addition as previously described provides certain enhanced properties in the finished paper product, including: lower caliper, increased strength, greater uniformity and a higher degree of smoothness, leading to improved printing characteristics.

A further embodiment relates to an improvement in press means for partially removing water from a web of paper product. Such press means usually includes a felt surface for contact with the web, and the improvement comprises treating the felt surfaces of the press means with a sufficient amount of a water-insoluble solvent to at least partially displace water in the felt surfaces and in the web. This increases the amount of water removed from the web during the operation of the press means.

Other aspects of the invention relate to papermaking systems which utilize water as a carrier for refining, processing, and transporting pulp and for forming a web of paper product in a paper product making apparatus. The apparatus usually has means for forming the web, means for depositing pulp upon the web forming means, press means for removing a portion of water from the web, and means for drying the web. The invention discloses an improvement which comprises substituting a water-insoluble solvent for water after the refining step to increase the removal of water from the web during the consolidation, pressing and drying steps. Alternatively, a water-insoluble solvent can be introduced onto the web during the pressing step to increase the removal of water from the web during the pressing and drying steps.

BRIEF DESCRIPTION OF THE DRAWINGS

The advantages in properties of paper sheets made according to this invention compared to those made by conventional methods are illustrated by the attached drawing figures wherein.

DETAILED DESCRIPTION OF THE INVENTION

Figure 1:
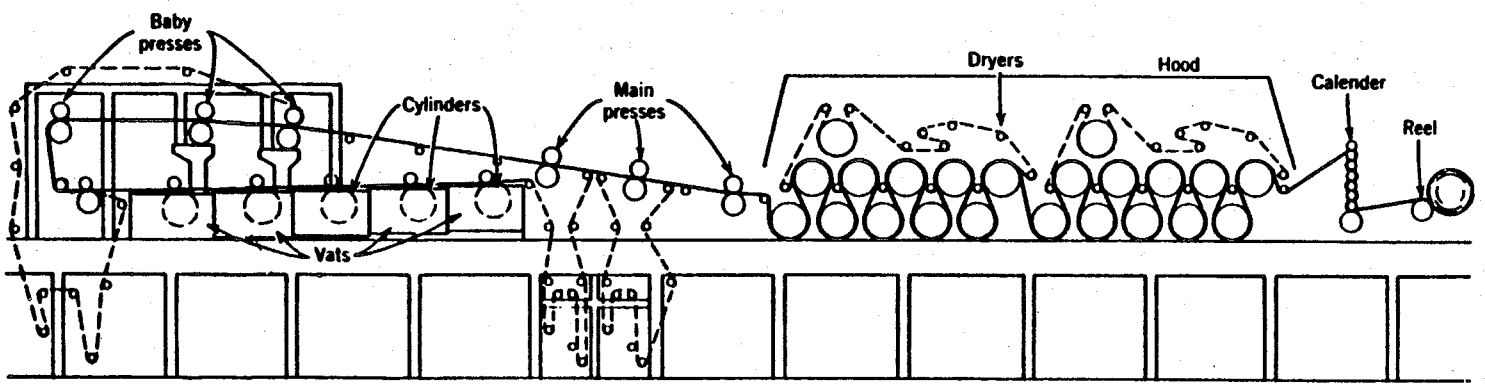
FIG. 1 is an illustration of a typical Fourdrinier single wire paper-making machine.

The present invention generally relates to the use of a water-insoluble organic solvent which is added to the paper web after formation to preferentially wet the fibers and thereby displace water. This results in a substantial increase in the rate of water removal during the pressing and/or drying steps.

The economic effects of such increased water removal are a substantial savings in energy consumption (i.e., on the order of about 35 to 50% in the drying section) or, because most operations are dryer limited, a significant enhancement of productivity.

The use of the solvent, in either a straight or emulsion form, when added prior to the drying step, provides improvements in the properties of the finished product. Among the physical properties that can be improved are decreased caliper, greater smoothness, and increased strength. Furthermore, physical properties such as wet or dry strength, sizing, brightness, color, etc. can be enhanced by incorporating known papermaking chemical additives, including dyes, into the solvent prior to application of the solvent to the web. Preferably, the solvent and additives(s) are applied to the web after the pressing step for maximum retention of additive in the web, and thus, optimum cost efficiency of additive usage. With this procedure, it is possible to achieve nearly 100% retention of additive in the web, an amount which is substantially higher than that attainable by prior art methods for applying the additive.

Any organic solvent which is a liquid at ambient operating temperatures, and preferably those which do not contain polar groups, can be utilized in the invention. This would include paraffinic, aliphatic, or aromatic organic solvents such hexane, decane, kerosene, gasoline, benzene, toluene, and the like. Such solvents have much lower surface or interfacial tension, which enables preferential wetting of the fibers and concomitant displacement of water, thus facilitating water removal during the subsequent pressing and drying steps.

In addition, the preferred solvent should advantageously possess all of the following properties:

(1) low water solubility;
(2) low odor;
(3) low toxicity to operators;
(4) low cost;
(5) low vapor pressure;
(6) low boiling point;
(7) low surface tension; and
(8) high solvency or KB value.

While solvents having any flash points can be used, the solvents having a relatively high flash point with an appropriate vapor pressure are desired in order to minimize the possibility of fire or explosion. When low flash point solvents are used, proper precautions regarding fire or explosion hazards should be followed.

At this time, it is believed that odorless kerosene is the preferred solvent which has the best balance of these properties and meets most of the criteria for typical papermaking processes. By observing the appropriate precautions, however, a wide range of other solvents provide similar results. Such solvents include halogenated (primarily chlorinated) organic compounds which are liquids over the temperature range of −20° to 150° C., such as ethylene dichloride or carbon tetrachloride.

Solvents with a higher solvency (Kauri Butanol or KB Value) may be required to solubilize and transfer certain chemical additives to the web. The invention also contemplates the use of a combination of two or more solvents to achieve optimum water displacement performance.

Preferably, the solvent alone (i.e., substantially pure solvent) is directly applied at any point in the process after formation of the web. It can be directly applied to the web; to the felt surfaces of the press; or to the web prior to the dryer section for transfer to the web. The amount of solvent utilized is not critical to the invention. The lower limit would be an amount sufficient to at least partially wet the fibers of the web and displace water therefrom so as to increase the rate of water removal in subsequent steps. The maximum amount of solvent utilized would be governed by economic or practical considerations relating to the cost of the solvent which bear on the solvent condensation, heat transfer or recycling system, as well as the incremental increase in efficiency achieved at very high levels. Emulsions of the solvent in water can also be used to apply the solvent to the web, as described above.

The solvent can be introduced at any point in the papermaking process after formation of the web but before the paper is dry. If added in appropriate amount to the web on the wire or in the press, an increase in consistency is achieved upon exiting the press section. This can amount to an increase of about 10% or greater. Over and above the consistency increase, it will also cause an increased rate of water removal in the drying section. The combination of these two factors can result in a saving of as much as 30 to 40% of steam usage in the dryer section or, at the option of the papermaker, a major increase in product output.

The invention also contemplates adding the solvent at more than one location to achieve the specific results described previously. If added after the press section, the solvent provides an increased rate of water removal while avoiding the decrease in caliper. Also, the papermaking chemical additives may be incorporated in the solvent at more than one location, if desired.

Although these solvents are more expensive than water, it is possible to recycle the solvent by recovering spent solvent. Such recovery of spent solvent can be accomplished by various means, such as carbon adsorption or through a condenser. After the solvent is separated from any water in the system, the solvent is then reused. Other recovery methods known to those skilled in the art can also be used for recycling solvent.

If the solvent is applied in emulsion form prior to the dryer section, the increase in consistency, coupled with decrease in caliper exiting the press section can be avoided, while still obtaining the greater rate of water removal in the dryer section. Generally, a greater fluid volume of emulsion is required to achieve results comparable to the direct application of solvent.

One aspect of the present invention relates to the use of at least one water-insoluble organic solvent for treating the press felt. This treatment markedly increases the amount of water removal at this stage of the papermaking process. The result is that the drying time of the product, along with its corresponding energy requirement, are substantially reduced.

In normal press section operation, the consistency increases to about 30%–40%. The balance represents the approximate amount of water held within the fibers. Highly refined or beaten pulps can hold more water, and once-dried pulps usually contain less. The use of water-insoluble solvents for treating the felt surfaces of the presses enables the paper product to have greater homogeneity and thus allows the product to be made thinner with better uniformity and strength. Also, a paper product is obtained that has better smoothness and this results in better printing properties.

The solvent can be applied to the felt intermittently or continuously. The application of the solvent to the felt can be accomplished by any of a variety of methods. This would include, for example, showering, spraying, or pouring the solvent onto either side of the felt surface in a manner similar to that used for cleaning the felt. The only requirement is that the solvent must be applied in a manner to completely wet the felt in order to displace much or all of the water therefrom. Also, the solvent can be applied in the form of an emulsion.

In a preferred embodiment, the solvent is continually applied to the felt such that a shutdown of the system is avoided. The amount of solvent used to wet the felt is not critical to the methods of this invention. From a practical standpoint, a minimum amount of solvent should be used in order to minimize the cost and quantity of solvent needed. The minimum necessary amount of solvent to be applied to the felt will depend upon the amount of paper product being contacted and can be routinely determined by one skilled in the art. The felt surfaces must be uniformly wetted by the solvent for optimum results. Also, some of the solvent must be transferred to the paper web to assist in the displacement of the free water.

Another aspect of the invention relates to the incorporation of various chemical additives into the solvent for application to the web to improve the properties of the final paper product. Such additives are desirable for imparting various features into the paper products. According to the prior art, these additives are normally applied to the paper at the wet end of the paper making machine. This procedure is inefficient in that the amount of additive retained by the final paper product is less than 100%, and often relatively low because it is carried away in the white water which drains through the wire.

Such chemical additives may be used for many purposes, including:

(1) increasing dry strength;
(2) increasing wet strength;
(3) internal sizing;
(4) adding color; or
(5) raising brightness When such additives are incorporated into the solvent, the amount of additive retained by the paper can be increased to a substantial degree over the process of introducing such additives in the wet end of the paper machine. As mentioned above, the retention of additive in the web often approaches 100%. Little or none is lost as is true on the wet end, where efficiency depends primarily on first pass retention. This enables either lesser amounts of additive to be used for the same improvement of property, or the same amount of additive used as in the wet end to obtain a further increase in the properties of the paper product.

EXAMPLES

The scope of the invention is further described in connection with the following examples which are set forth for the sole purpose of illustrating the preferred embodiments of the invention and which are not to be construed as limiting the scope of the invention in any manner.

EXAMPLE 1 (COMPARATIVE)

A paper sheet was made from a solution of bleached Kraft hardwood pulp having a consistency of 0.31% by the following procedure.

1. web formed
2. web pressed to 100 pounds
3. weight of pressed sheet recorded
4. sheet dried at 105° C. for one minute
5. sheet cooled in dessicator
6. weight of sheet recorded
7. steps 4, 5 and 6 repeated until the weight of the paper became constant.

The following table summarizes the data taken for 5 sheets.

TABLE II

| Properties of Sheet at Various Drying Times | | | |
|---|---|---|---|
| Drying Time (min.) | Weight of Sheet (g) | Consistency (%) | Moisture Content (%) |
| 0 | 3.73 | 38.2 | 61.8 |
| 1 | 3.23 | 44.1 | 55.9 |
| 2 | 2.77 | 51.3 | 48.7 |
| 3 | 2.36 | 60.3 | 39.7 |
| 4 | 2.00 | 71.3 | 28.7 |
| 5 | 1.70 | 83.7 | 16.3 |
| 6 | 1.51 | 94.1 | 5.9 |
| 7 | 1.44 | 98.6 | 1.4 |
| 8 | 1.43 | 99.7 | 0.3 |
| 9 | 1.42 | 100.0 | 0.0 |

The % consistency and % moisture were calculated by the following formulas:

$$\% \text{ consistency} = \frac{\text{dry weight}}{\text{wet weight}} \times 100\%$$

$$\% \text{ moisture} = 100 - \% \text{ consistency}$$

The Z directional strength was found to average 4.4 psi.

EXAMPLE 2

The procedure of Example 1 was repeated except that after step 2, the sheet was soaked in carbon tetrachloride for one minute, and then pressed to 100 pounds. The remainder of the steps of Example 1 (i.e., steps 3–9) were then completed.

The results are tabulated below:

TABLE I

| Properties of Sheet at Various Drying Times | | | |
|---|---|---|---|
| Drying Time (min.) | Weight of Sheet (g) | Consistency (%) | Moisture Content (%) |
| 0 | 2.98 | 47.8 | 52.2 |
| 1 | 2.36 | 60.3 | 39.7 |
| 2 | 1.95 | 73.1 | 26.9 |
| 3 | 1.64 | 86.8 | 13.2 |
| 4 | 1.48 | 96.5 | 3.5 |
| 5 | 1.43 | 99.6 | 0.4 |
| 6 | 1.42 | 100.0 | 0.0 |

Figure 2:
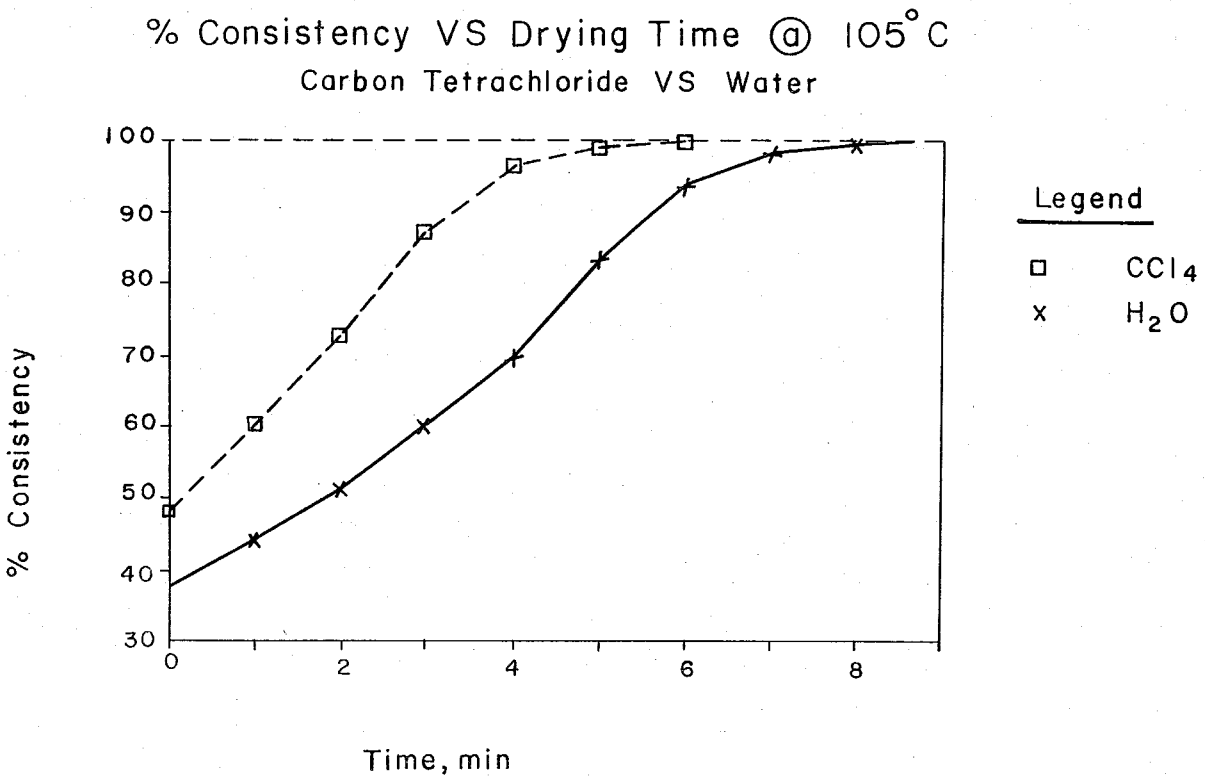
FIG. 2 is a graph of percent consistency vs. drying time for paper sheets prepared by the method of the invention and the prior art.

A graphical comparison of the results of Examples 1 and 2 can be found in FIG. 2.

The Z directional strength of these sheets was found to average 6.4 psi. This is an increase of approximately 45% over sheets not treated with the solvent.

The amount of heat required to dry these sheets to 94% consistency was reduced by 36%. Part of the energy savings derives from the increase in consistency after pressing, from 38.2 to 47.8%. A significant part of the energy saving further derives from the increased rate of drying of the solvent-treated sheet, as shown by the inflection of the curve in FIG. 2.

In this particular case, 15% of the energy saving is derived from the increase in consistency after pressing, and 21% is derived from the inherently increased rate of drying, for a total of 36% energy saving.

EXAMPLE 3

Figure 3:
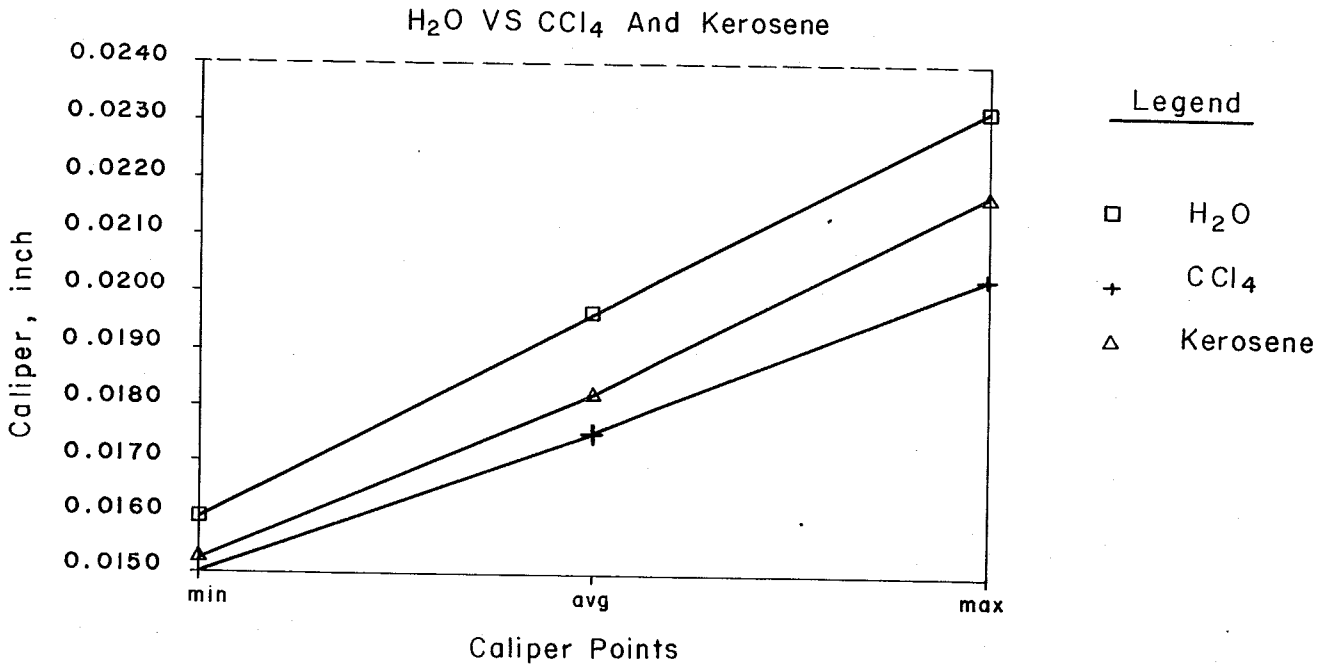
FIG. 3 is an illustration of caliper for paper sheets prepared by the methods of the invention and the prior art.

Utilizing the procedures described in Examples 1 and 2, an experiment was conducted in which carbon tetrachloride and kerosene were compared with the conventional papermaking process using only water. FIG. 3 shows that the caliper of the conventionally prepared handsheet is higher than those made with the solvents carbon tetrachloride and water.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A method for increasing the rate of water removal from a web of a paper product during consolidation, pressing and drying which comprises: applying at least one non-polar organic solvent to the web after formation but before the web is dried in a drying stage, which solvent is applied in an amount sufficient to at least partially displace water from between the fibers of the web; and at least partially displacing water from the web by a pressing stage.

2. The method of claim 1 wherein the web is treated by a non-polar organic solvent and water.

3. The method of claim 2 wherein the emulsion is applied before or during the pressing stage.

4. The method of claim 1 wherein the solvent is applied prior to pressing or during pressing.

5. The method of claim 1 wherein the web is treated by a first portion of the solvent prior to pressing and by a second portion of the solvent during pressing.

6. The method of claim 1 wherein the solvent is introduced continuously during pressing.

7. The method of claim 1 which further comprises selecting the solvent from one of paraffinic, aliphatic, or aromatic organic compounds.

8. The method of claim 1 which further comprises adding to the solvent at least one chemical additive for modifying or improving a property of the final paper product prior to treating the web with the solvent.

9. In a paper product manufacturing method which includes the steps of deposting pulp upon a screen to form a web of paper fiber, removing a portion of the water from the deposited web by pressing the web in press means having a press felt surface, and drying the pressed web, the improvement which comprises treating the press felt surface with a sufficient amount of at least one non-polar organic solvent which is subsequently transferred to the web in an amount sufficient to at least partially displace water between the fibers of the web, thereby making the water more readily available for displacement and removal from the web; and at least partially displacing water from web during pressing.

10. The method of claim 9 wherein the surface treating step comprises continuously introducing the solvent onto the press felt.

11. The method of claim 9 wherein the felt treating step comprises intermittently introducing the solvent onto the press felt.

12. The method of claim 9 which further comprises adding to the solvent at least one chemical additive for modifying or improvidng a property of the final paper product prior to treating the web with the solvent.

13. In a paper product manufacturing method which includes the steps of depositing pulp upon a screen to form a web of paper fiber, removing a portion of the water from the deposited web by pressing the web in press means, and drying the pressed web, the improvement which comprises increasing the drying rate of the pressed web or increasing the rate of production of the dried web by at least partially displacing water between the fibers of the web with at least one non-polar organic solvent during the pressing stage to obtain a web containing the solvent between the fibers in place of some of the water prior to drying the web.

14. The method of claim 13 wherein the web is treated by a first portion of the solvent before the pressing stage and by a second portion of the solvent during the pressing stage.

15. The method of claim 14 which further comprises adding to said first solvent portion at least one paper product property improving additive prior to treating the web.

16. The method of claim 14 which further comprises adding to said second solvent portion at least one paper product property improving additive prior to treating the web.

17. A method for improving at least one property of a final paper product which comprises treating a fiber web after formation with a sufficient amount of at least one non-polar organic solvent prior to pressing and drying such that during pressing, a portion of the water between the fibers of the web is diplaced by the solvent to obtain greater compaction during pressing, so as to improve at least one property of the final paper product.

18. The method of claim 17 wherein the web is treated by a non-polar organic solvent emulsion and water.

19. The method of claim 17 which further comprises adding to the solvent at least one paper product property improvidng additive.

20. A method for improving at least one property of a final paper product or increasing the efficiency of transfer of a property improving additive to said paper product which comprises treating a fiber web after formation and during the pressing stage with a sufficient amount of at least one non-polar organic solvent containing at least one property improving additive, such that, after the pressing operation, a portion of the water between the fibers of the web is displaced by the solvent and additive so as to introduce the additive into the web so that it is enabled to improve at least one property of the final paper product.

21. The method of claim 20 wherein the web is treated by a non-polar organic solvent and water emulsion wherein the water contains the additive.

22. The method of claim 20 wherein the web is treated by a first portion of the solution before the pressing stage and by a second portion of the solution during the pressing stage.

23. The method of claim 20 wherein the solution is applied to a press felt surface of press means utilized in the pressing stage and wherein the solution is subsequently transferred to the web during the pressing stage.

* * * * *